US005697225A

United States Patent [19]

Wada

[11] Patent Number: 5,697,225

[45] Date of Patent: Dec. 16, 1997

[54] ABSORPTION TYPE REFRIGERATING APPARATUS

[75] Inventor: Keiji Wada, Ohra-gun, Japan

[73] Assignee: Sanyo Electric Co., Ltd., Osaka-Fu, Japan

[21] Appl. No.: 699,530

[22] Filed: Aug. 19, 1996

[51] Int. Cl.[6] ..... F25B 15/00

[52] U.S. Cl. ..... 62/148; 62/141

[58] Field of Search ..... 62/101, 104, 105, 62/141, 148, 476

[56] References Cited

U.S. PATENT DOCUMENTS

| | | | |
|---|---|---|---|
| 5,156,013 | 10/1992 | Arima et al | 62/148 |
| 5,517,830 | 5/1996 | Ohuchi et al. | 62/476 |
| 5,586,447 | 12/1996 | Sibik et al. | 62/141 |

FOREIGN PATENT DOCUMENTS 484077 3/1992 Japan .

*Primary Examiner*—William Doerrler

*Attorney, Agent, or Firm*—Weingarten, Schurgin, Gagnebin & Hayes LLP

[57] ABSTRACT

In an absorption type refrigerating apparatus which comprises a temperature detector 30 for detecting the outlet temperature of cold water supplied from an evaporator 4 and a controller 31 for carrying out PID control of the amount of combustion of a burner B installed in a high-temperature regenerator 1 by comparing a detection temperature with a set temperature when the detection temperature of the temperature detector is lower than (the set temperature+a predetermined temperature 1), and for controlling the amount of combustion of the burner B to a value larger than the amount of combustion based on PID control when the detection temperature is equal to or higher than (the set temperature+the predetermined temperature 1), the controller which has received a signal from the temperature detector at the time of the start of operation (start-up) is activated to control the amount of combustion of the burner B to a value larger than the amount of combustion based on PID control so as to increase the capacity of the absorption type refrigerating apparatus, thereby shortening the start-up time and stabilizing the cold water outlet temperature at the same time.

6 Claims, 1 Drawing Sheet

ABSORPTION TYPE REFRIGERATING APPARATUS

BACKGROUND OF THE INVENTION

1. Field of the Invention

This invention relates to an absorption type refrigerating apparatus and, more specifically, to an absorption type refrigerating apparatus having a controller which is capable of proportional, derivative and integral control of the amount of heating in a regenerator according to the cold water outlet temperature.

2. Background Art

JP-A 199509/1990 (the term "JP-A" as used herein means an "unexamined published Japanese patent application"), for example, discloses a controller for carrying out proportional, derivative and integral control of the amount of heating in a regenerator (generator) of an absorption type refrigerating apparatus, which automatically tunes the parameters of proportional, derivative and integral control based on human experience according to fuzzy inference by forcedly changing a load during trial operation of the absorption type refrigerating apparatus after it has been installed.

In the above prior art, in order to shorten a start-up time by reducing the outlet temperature of cold water from an evaporator to a preset temperature in a short period of time at the time of the start of an absorption type refrigerating apparatus, it is generally necessary to carry out highly responsive control (increasing a proportional control parameter, for example) by controlling the parameters of proportional, derivative and integral control (to be referred to as "PID control" hereinafter).

Further, in order to carry out stable control without hunting by stabilizing the output temperature of cold water, it is generally necessary to carry out low responsive control (decreasing a proportional control parameter, for example) by controlling PID control parameters.

In this way, a reduction in the start-up time of the cold water outlet temperature and the stabilization of the cold water outlet temperature conflict with each other in the prior art PID control. Therefore, either one of them has to be sacrificed to some extent.

That is, when stress is laid on a reduction in the start-up time of the cold water outlet temperature, the cold water outlet temperature becomes unstable whereas when stress is laid on the stabilization of the cold water outlet temperature, the start-up time of the cold water outlet temperature is prolonged.

SUMMARY OF THE INVENTION

The present invention has been made to solve the above problem provides an absorption type refrigerating apparatus for supplying cold water from an evaporator by forming refrigerant and absorption solution circulation paths by connecting a regenerator, a condenser, the evaporator, an absorber and the like by pipes, the apparatus comprising a temperature detector for detecting the outlet temperature of cold water supplied from the evaporator and a controller for carrying out proportional, derivative and integral control of the amount of heating in the regenerator by comparing a detection temperature with a set temperature when the detection temperature detected by the temperature detector is lower than (the set temperature+a predetermined temperature) and controlling the amount of heating in the regenerator to a value larger than the amount of heating based on the proportional, derivative and integral control when the detection temperature is equal to or higher than (the set temperature+the predetermined temperature).

The present invention claimed in claim 2 provides an absorption type refrigerating apparatus wherein the amount of heating in the regenerator is controlled to the maximum when the detection temperature is equal to or higher than (the set temperature+the predetermined temperature).

Further, the present invention provides an absorption type refrigerating apparatus for supplying cold water from an evaporator by forming refrigerant and absorption solution circulation paths by connecting a regenerator, a condenser, the evaporator, an absorber and the like by pipes, the apparatus comprising a temperature detector for detecting the outlet temperature of cold water supplied from the evaporator and a controller for carrying out proportional, derivative and integral control of the amount of heating in the regenerator by comparing a detection temperature with a set temperature when the detection temperature detected by the temperature detector is lower than (the set temperature+a predetermined temperature), controlling the amount of heating in the regenerator to a value larger than the amount of heating based on the proportional, derivative and integral control when the detection temperature is equal to or higher than (the set temperature+the predetermined temperature), and changing the predetermined temperature in proportion to a proportional band of the proportional control.

The present invention provides an absorption type refrigerating apparatus for supplying cold water from an evaporator by forming refrigerant and absorption solution circulation paths by connecting a regenerator, a condenser, the evaporator, an absorber and the like by pipes, the apparatus comprising a temperature detector for detecting the outlet temperature of cold water supplied from the evaporator and a controller for carrying out proportional, derivative and integral control of the amount of heating in the regenerator by comparing a detection temperature with a set temperature when the detection temperature detected by the temperature detector is higher than (the set temperature−a predetermined temperature) and controlling the amount of heating in the regenerator to a value smaller than the amount of heating based on the proportional, derivative and integral control when the detection temperature is equal to or lower than (the set temperature−the predetermined temperature).

The present invention provides an absorption type refrigerating apparatus wherein the amount of heating in the regenerator is controlled to the minimum when the detection temperature is equal to or lower than (the set temperature−predetermined temperature).

Further, the present invention provides an absorption type refrigerating apparatus for supplying cold water from an evaporator by forming refrigerant and absorption solution circulation paths by connecting a regenerator , a condenser, the evaporator, an absorber and the like by pipes, the apparatus comprising a temperature detector for detecting the outlet temperature of cold water supplied from the evaporator and a controller for carrying out proportional, derivative and integral control of the amount of heating in the regenerator by comparing a detection temperature with a set temperature when the detection temperature detected by the temperature detector is higher than (the set temperature−a predetermined temperature), controlling the amount of heating in the regenerator to a value smaller than the amount of heating based on the proportional, derivative and integral control when the detection temperature is equal to or lower than (the set temperature−the predetermined temperature), and changing the predetermined temperature in proportion to a proportional band of the proportional control.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

A first embodiment of the present invention is described in detail hereinunder with reference to the accompanying drawings.

Figure 1:
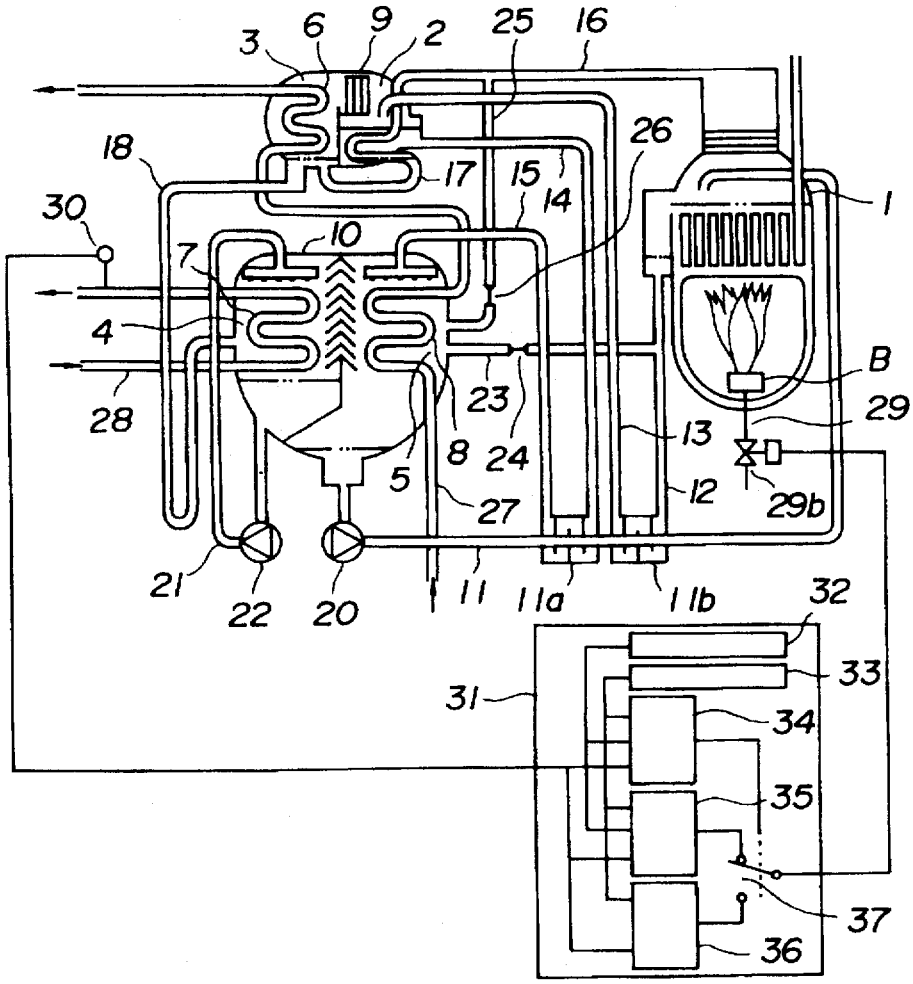
FIG. 1 is a circuit diagram of an absorption type refrigerating apparatus according to one embodiment of the present invention.

Reference letter A shown in FIG. 1 is a double-effect absorption type refrigerating machine (to be referred to as "absorption type refrigerating apparatus" hereinafter) which uses water ($H_2O$) as a refrigerant and a lithium bromide (LiBr) solution as an absorption solution.

In FIG. 1, reference numeral 1 is a high-temperature regenerator which uses a burner B as a heat source for burning such fuel as a gas, 2 a low-temperature regenerator, 3 a condenser, 4 an evaporator, 5 an absorber, 6 a condenser heat exchanger, 7 an evaporator heat exchanger, 8 an absorber heat exchanger, 9 an upper barrel which houses the low-temperature regenerator 2 and the condenser 3 and 10 a lower barrel which houses the evaporator 4 and the absorber 5.

These units are connected by absorption solution pipes 11 to 15 and refrigerant pipes 16 to 18. Reference symbol 11*a* is a low-temperature heat exchanger, 11*b* a high-temperature heat exchanger, 20 an absorption solution pump, 21 a refrigerant solution circulation pipe and 22 a refrigerant circulation pump. Reference numeral 23 is an absorption solution bypass pipe which connects the absorber 5 to the absorption solution pipe 16 at an intermediate position and has an open/close valve 24, and 25 is a refrigerant bypass pipe which connects the absorber 5 to the refrigerant pipe 16 at an intermediate position and has an open/close valve 26.

Reference numeral 27 is a cooling water pipe along which the absorber heat exchanger 8 and the condenser heat exchanger 6 are provided. Reference numeral 28 is a cold/hot water pipe along which the evaporator heat exchanger 7 is provided.

Reference numeral 29 is a fuel supply pipe connected to the burner B and 29*b* is a fuel control valve provided along the fuel supply pipe 29.

Reference numeral 30 is a detector (to be referred to as "temperature detector" hereinafter) for detecting the outlet temperature of cold/hot water (to be referred to as "cold/hot water temperature" hereinafter) provided on the evaporator outlet side of the cold/hot water pipe 28. Reference numeral 31 is a controller for receiving a signal from the temperature detector 30 and outputting an opening signal to the fuel control valve 29*b* according to the cold/hot water temperature. This controller 31 comprises a cold/hot water outlet temperature setting unit 32, a PID constant setting unit 33, a control switch 34, a PID computing unit 35, a forced controller 36 and a change-over switch 37 whose contact piece is switched in response to a signal from the control switch 34.

The cold water outlet temperature is set to 7° C., for example, by the cold/hot water outlet temperature setting unit 32 during the operation of supplying cold water from the cold/hot water pipe 28 which will be described hereinafter. Each constant, i.e., parameter of PID control is preset to balance between control speed and stability, for example.

The control switch 34 judges whether or not the detection temperature of the temperature detector 30 is equal to or higher than an upper limit temperature of 8° C. obtained by adding a predetermined temperature 1 (for example, 1° C.) to a cold water set temperature set by the cold/hot water outlet temperature setting unit 32 and equal to or lower than a lower limit temperature of 6° C. obtained by subtracting a predetermined temperature 2 (for example, 1° C.) from the cold water set temperature. When the detection temperature is equal to or higher than the upper limit temperature or equal to or lower than the lower limit temperature, the contact piece of the change-over switch 37 is switched to the side of the forced controller 36, and when the detection temperature is equal to or lower than the upper limit temperature and equal to or higher than the lower limit temperature, the contact piece of the change-over switch 37 is switched to the side of the PID computing unit 35.

Figure 2:
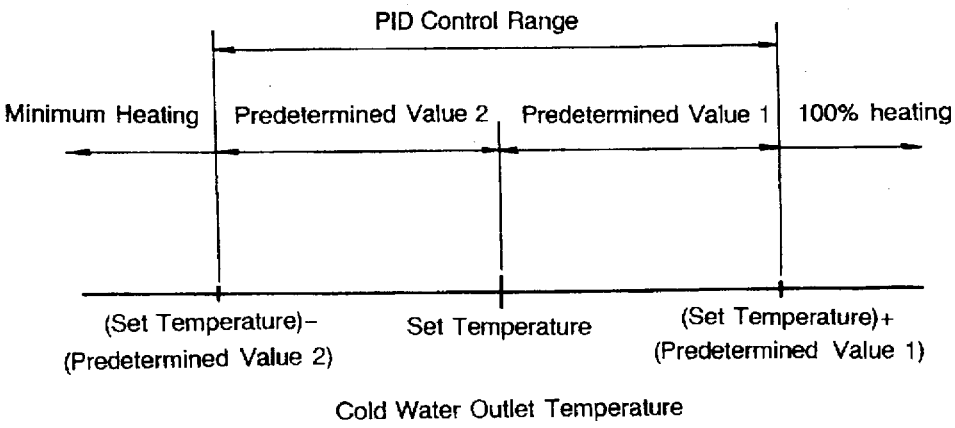
FIG. 2 is a diagram showing the relationship between the cold water outlet temperature and control of the amount of heating in the regenerator.

The PID computing unit 35 carries out PID computation in accordance with the detection temperature based on a constant set by the PID constant setting unit 33 and outputs an opening signal. The forced controller 36 outputs a full opening signal (100%) or a preset minimum opening (for example, 30%) signal to the fuel control valve 29*b* in accordance with the detection temperature. By switching by the change-over switch 37 of the control switch 34, as shown in FIG. 2, the opening of the control valve 29*b* is controlled to the minimum when the detection temperature of the temperature detector 30, i.e., the cold water outlet temperature is equal to or lower than the lower limit temperature (cold water set temperature–predetermined temperature 2) so that the amount of heating by the burner B in the high-temperature regenerator 2 becomes minimal. When the cold water outlet temperature is equal to or higher than the upper limit temperature (cold water set temperature+predetermined temperature 1), the opening of the control valve 29*b* is controlled to 100% so that the amount of heating by the burner B in the high-temperature regenerator 1 becomes maximal. Further, when the detection temperature is higher than the lower limit temperature and lower than the upper limit temperature, the opening of the control valve 29*b* is controlled to an opening computed by the PID computing unit 35.

During the cold water supply operation of the absorption refrigerating apparatus A constituted as described above, the open/close valves 24 and 26 are closed, the controller 31 outputs an opening signal to the control valve 29*b* in accordance with the detection temperature of the temperature detector 30, and a required amount of fuel is supplied to the burner B and burnt. Owing to the combustion in the burner B, the absorption solution having a low concentration (to be referred to as "diluted absorption solution" hereinafter) in the high-temperature regenerator 1 is heated, refrigerant vapor is thereby separated from the diluted absorption solution, and the absorption solution now having an intermediate concentration (to be referred to as "intermediate absorption solution" hereinafter) flows into the low-temperature regenerator 2 through the high-temperature heat exchanger 11*b*. In the low-temperature regenerator 2, the intermediate absorption solution is heated by refrigerant vapor from the high-temperature regenerator 1, a refrigerant is further separated from the intermediate absorption solution, and refrigerant vapor flows into the condenser 3. The absorption solution having an increased concentration by the separation of the refrigerant (to be referred to as "concentrated absorption solution" hereinafter) flows into the absorber 5 through the low-temperature heat exchanger 11*a* and is sprayed.

The refrigerant condensed in the low-temperature regenerator 2 and flown into the condenser 3 and the refrigerant condensed in the low-temperature regenerator 2 flow into the evaporator 4 through the refrigerant pipe 18. In the evaporator 4, the refrigerant solution is sprayed into the evaporator heat exchanger 7 by the operation of the refrigerant circulation pump 22 and absorbs heat from cold water running through the evaporator heat exchanger 7 when it is evaporated. Then, the cold water whose temperature is reduced is supplied to the load. The evaporated refrigerant is absorbed into the concentrated absorption solution flown into the absorber 5 and sprayed. The diluted absorption solution whose concentration is reduced by absorbing the refrigerant is supplied into the high-temperature regenerator 1 through the low-temperature heat exchanger 11*a* and the high-temperature heat exchanger 11*b* by the operation of the absorption solution pump 20.

During the above operation of the absorption type refrigerating apparatus, the controller 31 receives a signal from the temperature detector 30. Then the PID computing unit 35 receives the cold water outlet temperature detected by the temperature detector 30, carries out PID computation, and outputs an opening signal. When the cold water outlet temperature is higher than the lower limit temperature and lower than the upper limit temperature, the change-over switch 37 is switched to the side of the PID computing unit 35 in response to a signal from the control switch 34. Therefore, an opening signal output by the PID computing unit 34 is directly supplied to the control valve 29*b* whose the opening is then controlled to an opening obtained by the PID computing unit 35. Thus PID control of the amount of heating is carried out.

Since, at the time of the start of the absorption type refrigerating apparatus, that is, at the time of start-up, the temperature and pressure of each unit of the absorption type refrigerating apparatus and hence, refrigerating capacity thereof is small, the cold water outlet temperature is higher than the upper limit temperature. Therefore, the control switch 34 switches the change-over switch 37 to the side of the forced controller 36. As a result, the control of the opening of the control valve 29*b* by the computation of the PID computing unit 35, i.e., PID control of the amount of heating in the high-temperature regenerator 1 is stopped. The forced controller 36 receives the cold water outlet temperature detected by the temperature detector 30 and outputs a 100% opening signal which is the maximum opening larger than an opening computed by the PID computing unit 36 and which is then supplied to the control valve 29*b* through the change-over switch 37. The control valve 29*b* which has received this opening signal is fully opened so that the combustion of the burner B becomes 100%, i.e., maximal, and the amount of heating in the high-temperature regenerator 1 exceeds the amount of heating by the control of the PID computing unit 35 and becomes maximal.

When the cold water outlet temperature is between the lower limit temperature and the upper limit temperature and the opening of the control valve 29*b* is controlled in response to an opening signal output by the operation of the PID computing unit 35 based on the cold water outlet temperature, even if the load sharply increases and the cold water outlet temperature exceeds the upper limit temperature, the control switch 34 switches the change-over switch 37 to the side of the forced controller 36 as in the above-described control at the time of start-up and PID control is stopped. The forced controller 36 also receives the cold water outlet temperature and outputs a 100% opening signal which is then supplied to the control valve 29*b* through the change-over switch 37. The control valve 29*b* which has received this opening signal is fully opened so that combustion of the burner B becomes 100% and the amount of heating in the high-temperature regenerator 1 becomes maximal.

Therefore, the refrigerant generation capacity of the high-temperature regenerator 1 and the refrigerating capacity of the absorption type refrigerating apparatus are controlled to the maximum, and the cold water outlet temperature lowers swiftly. Then, when the cold water outlet temperature falls below the upper limit temperature, the control switch 34 is activated to output a switch signal so that the change-over switch 37 is switched from the side of the forced controller 36 to the side of the PID computing unit 35. Therefore, an opening signal output by the PID computing unit 35 is supplied to the control valve 29*b* through the change-over switch 37. The PID computing unit 35 computes the opening of the control valve 29*b* based on the cold water outlet temperature, the cold water set temperature and PID constants, and outputs an opening signal. The opening of the control valve 29*b* is controlled to an opening computed by the PID computing unit 35, and the cold water outlet temperature is controlled substantially to a cold water set temperature.

As described above, when it is now the closing time of the office where cooling operation is carried out by supplying cold water from an absorption type refrigerating apparatus and the load sharply falls while the opening of the control valve 29*b* is controlled to the opening computed by the PID computing unit 35, the cold water outlet temperature sharply lowers. Then, the opening of the control valve 29*b* is reduced in response to an opening signal from the PID computing unit 35 and the capacity of the high-temperature regenerator 1 is thereby reduced. However, when the cold water outlet temperature is further reduced to a lower limit temperature of 6° C. or less by a sharp load reduction, the control switch 34 is activated to output a switch signal by which the change-over switch 37 is switched from the side of the PID computing unit 35 to the side of the forced controller 36 to stop PID control. When the cold water outlet temperature is lower than the lower limit temperature, the forced controller 36 outputs a minimum opening signal which is smaller than the opening at the time of stoppage of PID control and the opening signal is supplied to the control valve 29*b*.

Therefore, the control valve 29*b* is controlled to the minimum opening of 30% so that the amount of combustion in the burner B becomes minimal and smaller than the amount of combustion at the time of stoppage of PID control and the amount of heating in the high-temperature regenerator 1 is forcedly controlled to the minimum. Then, the amount of refrigerant vapor generated in the high-temperature regenerator 1 sharply decreases and the refrigerating capacity of the absorption type refrigerating apparatus also sharply drops and is controlled to the minimum.

When the refrigerating capacity becomes minimal, a reduction in the cold water outlet temperature stops and the cold water outlet temperature quickly rises in accordance with a cooling load. When the cold water outlet temperature exceeds the lower limit temperature, the control switch 34 is activated to output a switch signal by which the change-over switch 37 is switched from the side of the forced controller 36 to the side of the PID computing unit 35. Therefore, the opening signal output by the PID computing unit 35 is supplied to the control valve **29*b* through the change-over switch 37. The opening of the control valve 29*b* is controlled to an opening computed by the PID computing unit 35** and the cold water outlet temperature is controlled almost to a cold water set temperature.

Thereafter, the controller 31 is activated based on the cold water outlet temperature detected by the temperature detector 30. As explained above, when the cold water outlet temperature is higher than the upper limit temperature, the control switch 34 is activated and the burner B is controlled to the maximum combustion of 100% based on the opening signal from the forced controller 36 whereby the capacity of the absorption type refrigerating apparatus is controlled to the maximum. When the cold water outlet temperature is lower than the lower limit temperature, the control switch 34 is activated and the combustion of the burner B is controlled to the minimum based on an opening signal from the forced controller 36 whereby the capacity of the absorption type refrigerating apparatus is controlled to the minimum.

When the cold water outlet temperature is between the upper limit temperature and the lower limit temperature, the control switch 34 switches the change-over switch 37 to the side of the PID computing unit 35. Therefore, the opening of the control valve **29*b* is controlled in accordance with the opening signal from the PID computing unit 35** and the amount of combustion in the burner B is PID controlled.

According to the above first embodiment, when the cold water outlet temperature is higher than the upper limit temperature at the time of the start of an absorption type refrigerating apparatus or a sharp load increase in a short period of time, the control switch 34 is activated to switch the change-over switch 37 to the side of the forced controller 37 and the opening control of the control valve **29*b* is changed from control based on an opening signal from the PID computing unit 35, i.e., PID control, to control based on an opening signal from the forced controller 36** whereby the combustion of the burner B is controlled to a maximum of 100% and the capacity of an absorption type refrigerating apparatus becomes maximal. Therefore, when the cold water outlet temperature is high at the time of the start of operation or the load sharply increases in a short period of time, the cold water outlet temperature can be reduced in an extremely short period of time and start-up time can be greatly shortened.

Further, when the combustion of the burner B is controlled to a maximum of 100% whereby the capacity of an absorption type refrigerating apparatus becomes maximal and the cold water outlet temperature sharply falls below the upper limit temperature, the control of the control valve **29*b* is changed from control based on an opening signal from the forced controller 36 to control based on an opening signal from the PID computing unit 35, thereby making it possible to prevent hunting of the cold water outlet temperature near the cold water set temperature and stabilize the cold water outlet temperature after 100% heating operation of the high-temperature regenerator 1**.

When the cold water outlet temperature falls below the lower limit temperature at the time of a sharp and great load reduction, the control switch 34 is activated to switch the change-over switch 37 to the side of the forced controller 36, the control of the control valve **29*b* is changed from control based on an opening signal from the PID computing unit 35 to control based on an opening signal from the forced controller 36**, and the combustion of the burner B is controlled to the minimum whereby the capacity of the absorption type refrigerating apparatus becomes minimal. Therefore, the cold water outlet temperature can be elevated in a short period of time, that is, the time required to elevate the cold water outlet temperature can be greatly reduced.

Further, at the time of the start of an absorption type refrigerating apparatus or a great load change, the control switch 34 is activated to control the combustion of the burner B to 100% or the minimum. Therefore, it is not necessary to take a value which is set taking into consideration the start of operation or a great load change for the PID settings of PID control. Since it is good to take into consideration a load variation within the range between "cold water set temperature–predetermined temperature 2" and "cold water set temperature+predetermined temperature 1", i.e., 6° C. and 8° C., it is possible to carry out PID settings with ease and further stabilize the cold water outlet temperature.

In the above embodiment, when the cold water outlet temperature is higher than the upper limit temperature, PID control of the amount of heating based on the computation of the PID computing unit 35 is stopped and the combustion of the burner B is controlled to a maximum of 100% based on an opening signal from the forced controller 36. Even when the opening of the control valve **29*b* is controlled to an opening (up to 100%) larger than the opening of the control valve based on PID control, for example, an opening obtained by adding a predetermined opening (for example, 20%) to an opening based on PID control, or to a preset large predetermined opening (for example, 95% close to 100%), at the time of stoppage of PID control, function and effect which are almost the same or slightly worse than those obtained when the opening of the control valve 29*b*** is controlled to 100% as explained in the above embodiment can be obtained.

In the above embodiment, when the cold water outlet temperature is lower than the lower limit temperature, PID control of the amount of heating based on the computation of the PID computing unit 35 is stopped and the combustion amount of the burner B is controlled to a minimum of 30% based on an opening signal from the forced controller 36. Even when the opening of the control valve **29*b* is controlled to an opening smaller than the opening of the control valve based on PID control, for example, an opening obtained by subtracting a predetermined opening (for example, 20%) from an opening based on PID control, or to a preset small predetermined opening (for example, 35% close to 30%), at the time of stoppage of PID control, function and effect which are almost the same or slightly worse than those obtained when the opening of the control valve 29*b*** is controlled to a minimum of 30% as explained in the above embodiment can be obtained.

A second embodiment of the present invention is described hereinunder.

Since the second embodiment is the same as the first embodiment except that the operation of the control switch 34, its detailed description is omitted. The second embodiment is described as in the first embodiment with reference to FIGS. 1 and 2.

The control switch 34 adjusts the value of the predetermined temperature 1 which is an allowable value higher than the cold water set temperature and the value of the predetermined temperature 2 which is an allowable value lower than the cold water set temperature based on the value of a proportional band (P) as a proportional item for proportional control from the PID computing unit 35.

That is, the predetermined temperature 1 changes in proportion to the value of the proportional band (P) and determined such that predetermined temperature 1=P/2, for example.

At this point, when P=2, the predetermined temperature 1=1° C. as in the above first embodiment. Then in the case where the cold water set temperature is set to 7° C., the control switch 34 switches the change-over switch 37 to the side of the PID computing unit 35 when the cold water outlet temperature is lower than 8° C. and to the side of the forced controller 36 when the cold water outlet temperature is equal to or more than 8° C.

The predetermined temperature 2 also changes in proportion to the value of proportional band (P) and is determined such that predetermined temperature 2=P/2, for example.

At this point, when P=2, the predetermined temperature 2=1° C. as in the above first embodiment. Then in the case where the cold water set temperature is set to 7° C., the control switch 34 switches the change-over switch 37 to the side of the PID computing unit 35 when the cold water outlet temperature is higher than 6° C. and to the side of the forced controller 36 when the cold water outlet temperature is equal to or less than 6° C.

The predetermined temperature 1 and the predetermined temperature 2 vary in accordance with the change of the above proportional band (P). The larger the proportional band (P) the larger they become, and the smaller the proportional band (P) the smaller they become.

Generally speaking, PID control becomes low-responsive control (capable of stable control without hunting) when the proportional band (P) is large and highly-responsive control (liable to cause hunting) when the proportional band (P) is small.

When the predetermined temperature 1 and the predetermined temperature 2 are set to small values and the upper limit temperature and the lower limit temperature are fixed to levels close to the cold water set temperature in spite that the proportional band (P) is set to a large value based on the properties of each unit of an absorption type refrigerating apparatus, the proportional band (P) is ignored at a temperature range above the upper limit temperature and at a temperature range below the lower limit temperature. Therefore, the range of PID control is restricted to a narrow range between the upper limit temperature and the lower limit temperature. Thus there is no point in setting the proportional band (P) to a large value.

Therefore, according to the above second embodiment, control of the amount of heating in the high-temperature regenerator 1 which ignores the setting of the proportional band (P) can be avoided by determining the predetermined temperature 1 and the predetermined temperature 2 in accordance with the proportional band (P) as described above, and further stabilized operation control of an absorption type refrigerating apparatus can be effected in consideration of the setting of the proportional band (P).

It is to be distinctly understood that the invention is not limited to the above embodiments but may be otherwise variously embodied without departing from the spirit and scope thereof.

For instance, in the above embodiment in which a double-effect absorption type refrigerating apparatus has been described in FIG. 1, even when the present invention is applied to a single-effect absorption type refrigerating apparatus, the same function and effect as those of the above embodiment can be obtained.

The present invention is an absorption type refrigerating apparatus constituted as described above. According to the present invention when the cold water outlet temperature is equal to or more than (a set temperature+a predetermined temperature) at the time of the start of the absorption type refrigerating apparatus or a great load increase in a short period of time, the controller which has received a signal from the temperature detector is activated to stop PID control of the amount of heating in the regenerator and controls the amount of heating in the regenerator to the maximum or a value larger than the amount of heating based on PID control whereby the capacity of the absorption type refrigerating apparatus is further increased. Therefore, when the cold water outlet temperature is high at the time of the start of operation or when the load greatly increases in a short period of time, the cold water outlet temperature is reduced in a short period of time so that the start-up time can be shortened and a sharp load increase can be handled in a short period of time.

Meanwhile, not only when the cold water outlet temperature is kept below (a set temperature+a predetermined temperature) but also when the cold water outlet temperature sharply falls below (the set temperature+the predetermined temperature), the controller is activated to switch to control of the amount of heating in the regenerator based on PID control so that hunting at a temperature close to the set temperature of the cold water outlet temperature can be prevented, whereby the cold water outlet temperature is stabilized.

Since the predetermined temperature is changed in proportion to the proportional band of proportional control out of PID control, when the proportional band is set to a large value based on the properties of each unit of an absorption type refrigerating apparatus, the predetermined temperature is set to a large value accordingly, and the upper limit temperature becomes high so that the range of PID control can be prevented from being limited to a narrow range below the upper limit temperature that ignores the setting of the proportional band, that is, control of the amount of heating in the regenerator that ignores the setting of the proportional band can be avoided. Therefore, such function and effect that further stable operation control of an absorption type refrigerating apparatus can be effected by contriving the setting of the proportional band are added to the invention.

When the cold water outlet temperature falls below (the set temperature+the predetermined temperature) due to a sharp reduction in the load of the absorption type refrigerating apparatus or the like, the controller which has received a signal from the temperature detector is activated to stop PID control of the amount of heating in the regenerator and controls the amount of heating in the regenerator to the minimum or a value smaller than the amount of heating based on PID control so as to further reduce the capacity of the absorption type refrigerating apparatus. Therefore, when the load greatly drops in a short period of time, a reduction in the cold water outlet temperature can be stopped in a short period of time and can be elevated.

Meanwhile, not only when the cold water outlet temperature is kept higher than (the set temperature−the predetermined temperature) but also when the cold water outlet temperature sharply rises above (the set temperature+the the predetermined temperature), the controller is activated to switch to the control of the amount of heating in the regenerator based on PID control, whereby hunting at a temperature close to the set temperature of the cold water outlet temperature can be prevented. Therefore, the cold water outlet temperature can be stabilized.

Since the predetermined temperature is changed in proportion to the proportional band of proportional control out of PID control, when the proportional band is set to a large value based on the properties of each unit of an absorption type refrigerating apparatus, the predetermined temperature is set to a large value accordingly, and the lower temperature is lowered, whereby the range of PID control can be prevented from being limited to a narrow range above the lower limit temperature that ignores the setting of the proportional band, that is, control of the amount of heating in the regenerator that ignores the setting of the proportional band can be avoided. Therefore, such function and effect that further stable operation control of an absorption type refrigerating apparatus can be effected by contriving the setting of the proportional band.

What is claimed is:

1. An absorption type refrigerating apparatus for supplying cold water from an evaporator by forming refrigerant and absorption solution circulation paths by connecting a regenerator, a condenser, the evaporator, an absorber and the like by pipes, the apparatus comprising:

a temperature detector for detecting the outlet temperature of cold water supplied from the evaporator; and a controller for carrying out proportional, derivative and integral control of the amount of heating in the regenerator by comparing a detection temperature with a set temperature when the detection temperature detected by the temperature detector is lower than the temperature which is the set temperature plus a predetermined number of degrees and for controlling the amount of heating in the regenerator to a value larger than the amount of heating based on the proportional, derivative and integral control when the detection temperature is equal to or higher than the temperature which is the set temperature plus the predetermined number of degrees.

2. An absorption type refrigerating apparatus according to claim 1, wherein the amount of heating in the regenerator is controlled to the maximum when the detection temperature is equal to or higher than the temperature which is the set temperature plus the predetermined number of degrees.

3. An absorption type refrigerating apparatus for supplying cold water from an evaporator by forming refrigerant and absorption solution circulation paths by connecting a regenerator, a condenser, the evaporator, an absorber and the like by pipes, the apparatus comprising:

a temperature detector for detecting the outlet temperature of cold water supplied from the evaporator; and a controller for carrying out proportional, derivative and integral control of the amount of heating in the regenerator by comparing a detection temperature with a set temperature when the detection temperature detected by the temperature detector is lower than the temperature which is the set temperature plus a predetermined number of degrees, controlling the amount of heating in the regenerator to a value larger than the amount of heating based on the proportional, derivative and integral control when the detection temperature is equal to or higher than the temperature which is the set temperature plus the predetermined number of degrees, and changing the predetermined temperature in proportion to a proportional band of the proportional control.

4. An absorption type refrigerating apparatus for supplying cold water from an evaporator by forming refrigerant and absorption solution circulation paths by connecting a regenerator, a condenser, the evaporator, an absorber and the like by pipes, the apparatus comprising:

a temperature detector for detecting the outlet temperature of cold water supplied from the evaporator; and a controller for carrying out proportional, derivative and integral control of the amount of heating in the regenerator by comparing a detection temperature with a set temperature when the detection temperature detected by the temperature detector is higher than the temperature which is the set temperature minus a predetermined number of degrees and controlling the amount of heating in the regenerator to a value smaller than the amount of heating based on the proportional, derivative and integral control when the detection temperature is equal to or lower than the temperature which is the set temperature minus the predetermined number of degrees.

5. An absorption type refrigerating apparatus according to claim 4, wherein the amount of heating in the regenerator is controlled to the minimum when the detection temperature is equal to or lower than the temperature which is the set temperature minus predetermined number of degrees.

6. An absorption type refrigerating apparatus for supplying cold water from an evaporator by forming refrigerant and absorption solution circulation paths by connecting a regenerator, a condenser, the evaporator, an absorber and the like by pipes, the apparatus comprising:

a temperature detector for detecting the outlet temperature of cold water supplied from the evaporator; and a controller for carrying out proportional, derivative and integral control of the amount of heating in the regenerator by comparing a detection temperature with a set temperature when the detection temperature detected by the temperature detector is higher than the temperature which is the set temperature minus a predetermined number of degrees, controlling the amount of heating in the regenerator to a value smaller than the amount of heating based on the proportional, derivative and integral control when the detection temperature is equal to or lower than the temperature which is the set temperature minus the predetermined number of degrees, and changing the predetermined temperature in proportion to a proportional band of the proportional control.

* * * * *